US006790188B2

(12) United States Patent
Chen

(10) Patent No.: US 6,790,188 B2
(45) Date of Patent: Sep. 14, 2004

(54) FOOT-IMMERSING MASSAGING MACHINE

(76) Inventor: Chao Yang Chen, No. 456, Putz St., Fengyuan City, Taichung (TW), 420

( * ) Notice: Subject to any disclaimer, the term of this patent is extended or adjusted under 35 U.S.C. 154(b) by 108 days.

(21) Appl. No.: 10/179,180

(22) Filed: Jun. 26, 2002

(65) Prior Publication Data

US 2004/0002666 A1 Jan. 1, 2004

(51) Int. Cl.[7] ..... A61H 33/00

(52) U.S. Cl. ..... 601/22; 601/28; 601/32; 601/158; 607/86; 4/622

(58) Field of Search ..... 601/28, 22, 30, 601/32, 154, 158; 607/81, 85–7; 4/622

(56) References Cited

U.S. PATENT DOCUMENTS 4,620,529 A * 11/1986 Kurosawa ..... 601/157
5,588,161 A * 12/1996 Barradas ..... 601/22
5,716,331 A * 2/1998 Chang ..... 601/50
5,868,688 A * 2/1999 Avidor et al. ..... 601/87
6,149,611 A * 11/2000 Chen ..... 601/22
6,309,366 B1 * 10/2001 Maxwell ..... 601/166
6,405,390 B2 * 6/2002 Kuen ..... 601/158
6,568,000 B1 * 5/2003 Kaufman et al. ..... 601/158
6,602,212 B1 * 8/2003 Ahn ..... 601/154

* cited by examiner

*Primary Examiner*—Danton D. DeMille
(74) *Attorney, Agent, or Firm*—Troxell Law Office PLLC

(57) ABSTRACT

A foot-immersing massaging machine includes a body and an immersing vessel combined on the body. The body has a housing, a motor, a switch, a power cord, and a vibrator. The vibrator is fixed on an upper end of the shaft of the motor, and produces vibration when rotated by the motor. The immersing vessel has a vessel body and a soft massage cushion. The vessel body has a through hole in the bottom center for an upper portion of the vibrator to extend through upward, and the massage cushion is placed on the bottom of the vessel body and closes up the through hole, covering the vibrator with a gap between itself and the vibrator. Then a user can put the feet in the immersing vessel and receive massage performed by the vibrator at the same time.

10 Claims, 5 Drawing Sheets

FOOT-IMMERSING MASSAGING MACHINE

BACKGROUND OF THE INVENTION

This invention relates to a foot-immersing massaging machine, particularly to one performing sole massaging as well as immersing foot at the same time.

Foot immersing is a conventional method of developing health of our body, by using a vessel or a bathing tub to contain water of proper temperature and some medicine possibly added in the water for increasing effect of immersion. Then a user puts his/her feet in the water in the vessel for a certain period of time so as to let blood vessels to expand, promote blood circulation, relax muscles, and enhance metabolism of body cells. But its effect is quite limited.

So a foot-immersing massaging machine are made by some makers and put on the market, possible to immerse feet and perform sole massaging by water current at the same time. However, indirect massaging by water current may not acquire such a good effect as a direct massaging with some object to a sole may have. In addition, if a user cannot endure a long period of time in receiving hot water current massaging, he/she may pull out the feet for a break. Then after a while the user may again put the feet in the vessel, resulting in ineffectiveness in using.

SUMMARY OF THE INVENTION

This invention has been devised to offer a foot-immersing massaging machine to carrying out foot immersing and sole massaging at the same time.

The foot-immersing massaging machine in the invention includes a body and an immersing vessel. The body has a housing, a motor, a switch, a power cord, and a vibrator. The motor is installed in the housing, having a shaft protruding out of an upper surface of the housing. The switch is fixed at a proper location of the housing, connected electrically with the motor, and the power cord is connected with the motor and the switch. The vibrator is fixed on the shaft of the motor and produce minute vibration by means of an eccentric mode. The immersing vessel is combined on the body, having a vessel body and a soft massage cushion. The vessel body has an interior hollow, an open upper side for receiving the feet of a user therein and a center through hole for the upper portion of the vibrator to pass upward through. The massage cushion is made of rubber, polymer or the like, closing up the center through hole and covering the vibrator. Then a gap is formed between the inner surface of the massage cushion and the vibrator, and the outer surface of the massage cushion has many small projections for feet to step thereon for receiving massage.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
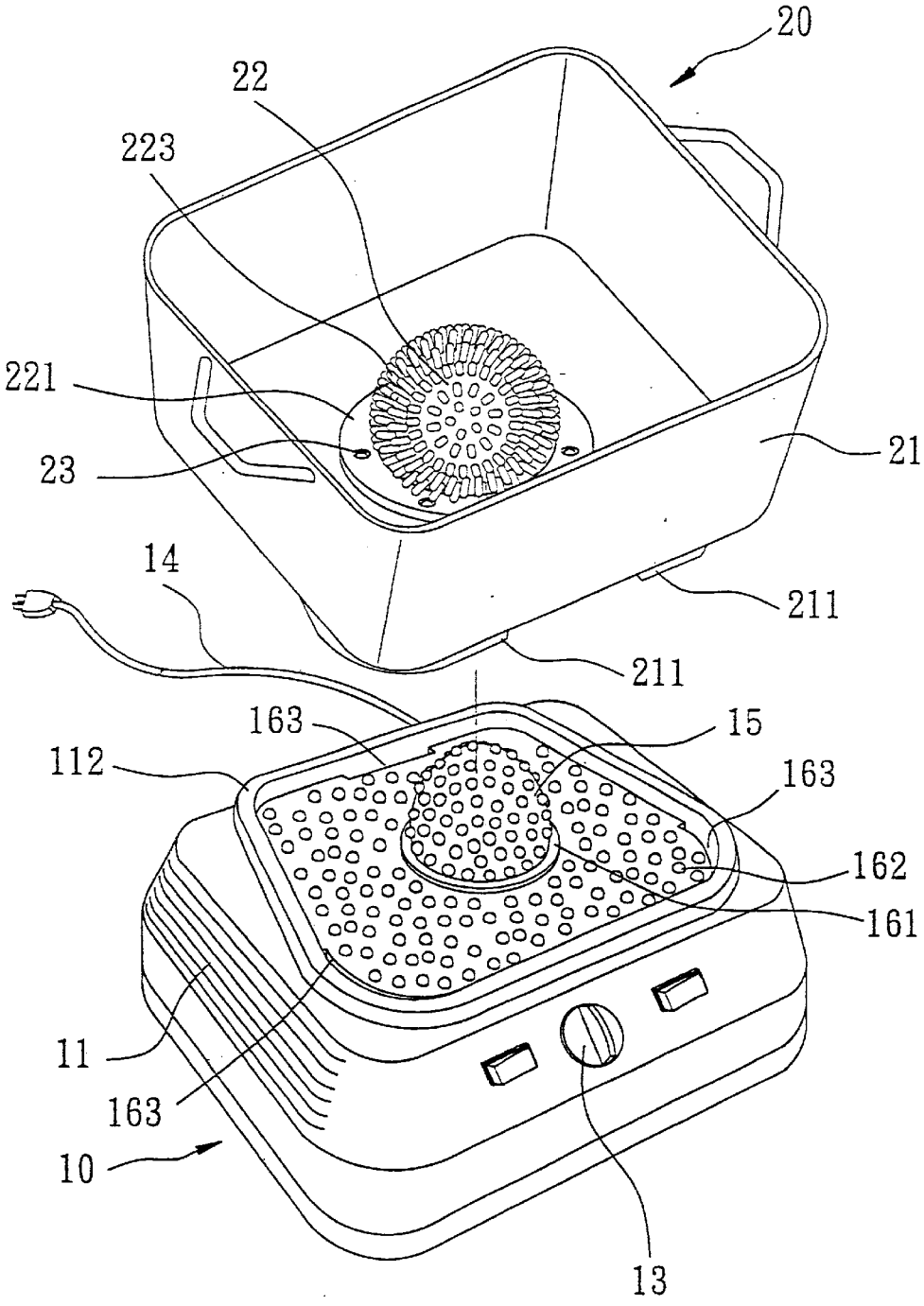
FIG. 1 is an exploded perspective view of a preferred embodiment of a foot-immersing massaging machine in the present invention.
Figure 2:
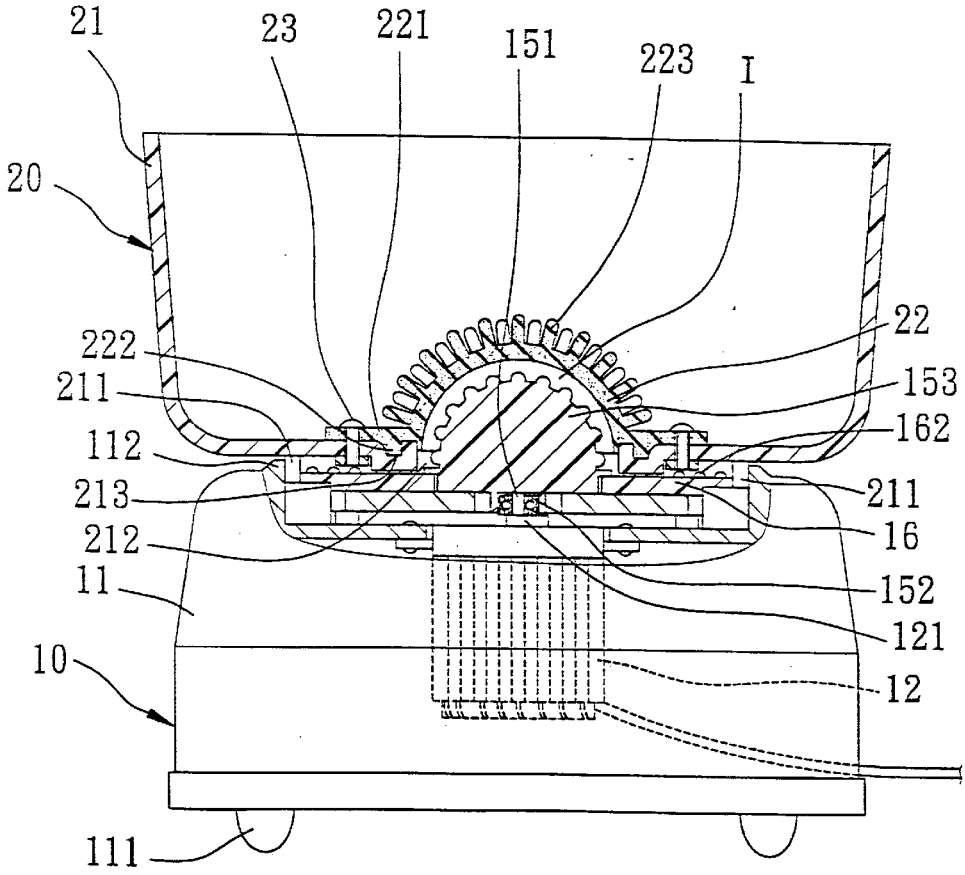
FIG. 2 is a cross-sectional view of the preferred embodiment of a foot-immersing massaging machine in the present invention.

A preferred embodiment of a foot-immersing massaging machine in the present invention, as shown in FIGS. 1 and 2, includes a body 10 and an immersing vessel 20 combined together.

The body 10 consists of a housing 11, a motor 12, a switch 13, a power cord 14, a vibrator 15 and an anti-slip cushion 16. The housing 11 is rectangular, and the motor 12 is installed in the housing 11. A plurality of shock-absorbing members 111 are attached under the housing 11 at four corners, absorbing vibration of the motor 12 when it is in operation. The housing 11 further has a trapezoidal circumferential projecting edge 112 formed in an upper surface.

The motor 12 has a shaft 121 extending upward through the upper surface of the housing 11, and a switch 13 is fixed on a side wall of the housing 11, connected electrically with the motor 12, with the power cord 14 extending through a side of the housing in the interior of the housing 11 and connected with the motor 12 and the switch 13.

The vibrator 15 is fixed on of the shaft 121 of the motor 12 extending upward out of the housing 11, having an eccentric shaft 151, a bearing 152 and a vibrating member 153. The eccentric shaft 151 is column-shaped, having one end fixed on the top of the shaft 121 at an eccentric point, and the other end fitting pivotally in the bearing 152, which is located at the center of the semicircular vibrating member 153. Therefore, the vibrating member 153 may be rotated by the eccentric shaft 151 via the bearing 152, producing minute vibration. Further, an anti-slip cushion 16 is covered on the area surrounded by the circumferential projecting edge 112 on the upper surface of the housing 11, having a center through hole 161 for the upper portion of the vibrating member 153 to pass through upward and a plurality of anti-slip small projections 162 formed on an upper surface. The anti-slip cushion 16 further has three insert recesses 163 formed spaced a part on a circumferential edge for easily placed inside of the circumferential edge 112.

The immersing vessel 20 is combined on the body 10, having a vessel body 21 and a soft massage cushion 22. The vessel body 21 is hollow and rectangular with an upper open side, having enough space for receiving two feet of a user and a stopping member consisting of three boards 211 fixed spaced apart under the bottom. The three boards 211 fits in the three insert recesses 163 of the anti-slip cushion 16 when the immersing vessel 20 is placed on the body 10, respectively having their outer edge contacting and restricted by the inner surface of the circumferential stop edge 112.

The vessel body 21 has a through hole 212 bored in its bottom for an upper half portion of the vibrating member 153 to protrude upward through, and a circumferential groove 213 in an upper surface around the through hole 212.

The soft massaging cushion 22 is semi-spherical with an interior hollow, having an annular flat member 221 around the lower annular portion, and an annular anti-leak ridge 222 formed under the bottom of the annular flat member 221 to fit in the annular groove 213 of the vessel body 21. The annular flat member 221 has six holes spaced apart equidistantly for bolts 23 to fit in to screw with the vessel body 21, combining the soft massaging cushion 22 with the vessel body 21. Further, a gap I is formed between the inner surface of the soft massaging cushion 22 and the vibrating member 153, having a larger size than the rotating radius of the eccentric shaft 151. The soft massaging cushion 22 further has a plurality of small projections 223 on an outer surface for feet to step on for massaging.

In using, as shown in FIG. 2, when the power cord 14 is connected to power and the switch 13 is turned on, the motor 12 is operated with its shaft 121 rotating the eccentric shaft 151, which rotates the vibrating member 153 together. Then the vibrating member 153 rotates and produces minute vibration.

Figure 3:
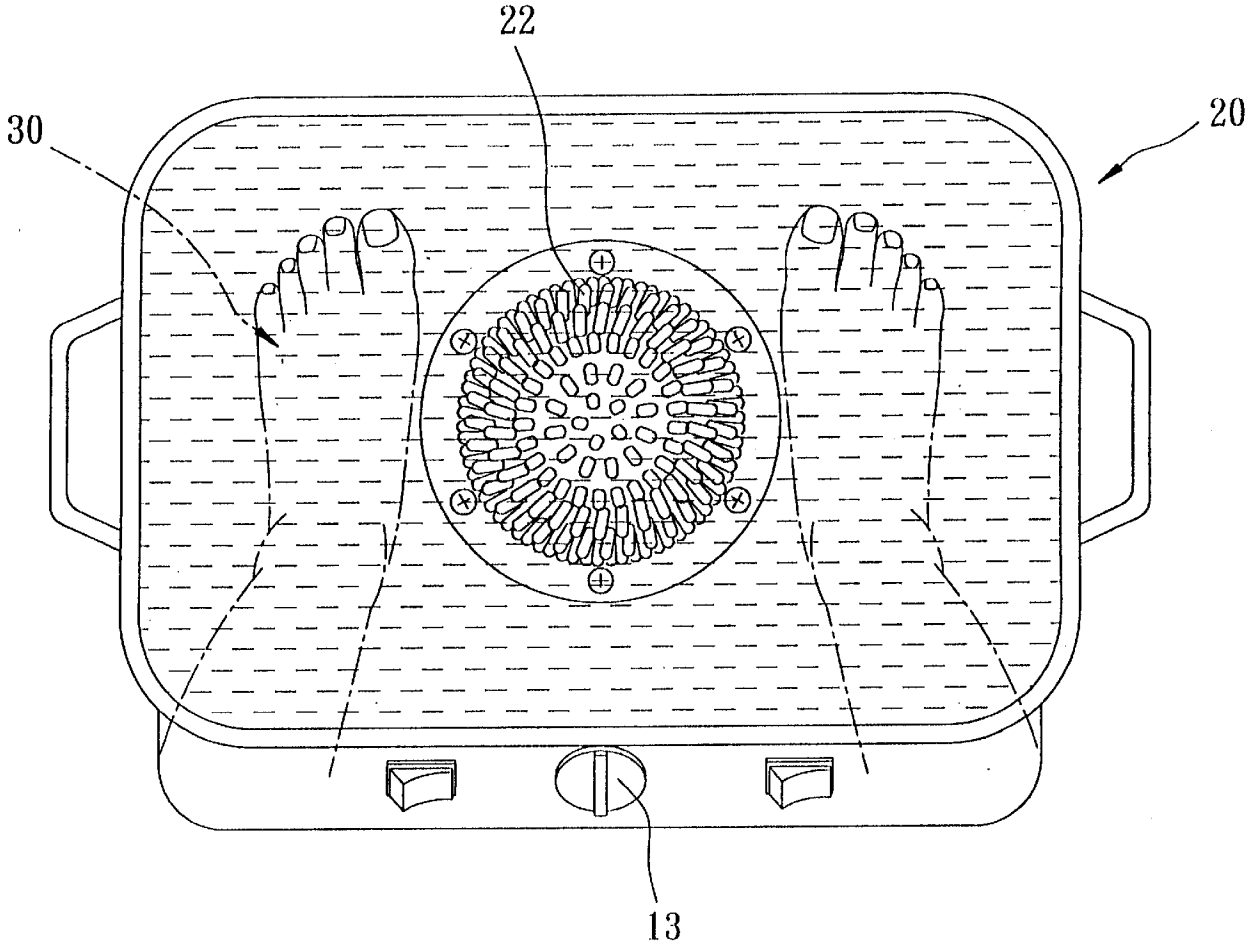
FIG. 3 is an upper view of the preferred embodiment of a foot-immersing massaging machine in the present invention, showing feet put in the immersing vessel, but not stepping on a massage cushion in the vessel.

As shown in FIG. 3, a user pours water of proper temperature in the immersing vessel 20 and adds some medicine in the water for augmenting medical effect. At this time the user does not step on the soft massaging cushion 22 yet, so there is the gap I between the soft massaging cushion 22 and the vibrating member 153. Then even if the vibrating member 153 is in operation and producing vibration, the vibration cannot be transmitted to the immersing vessel 20 and the feet 30 of the user so the user feels no vibration.

Figure 4:
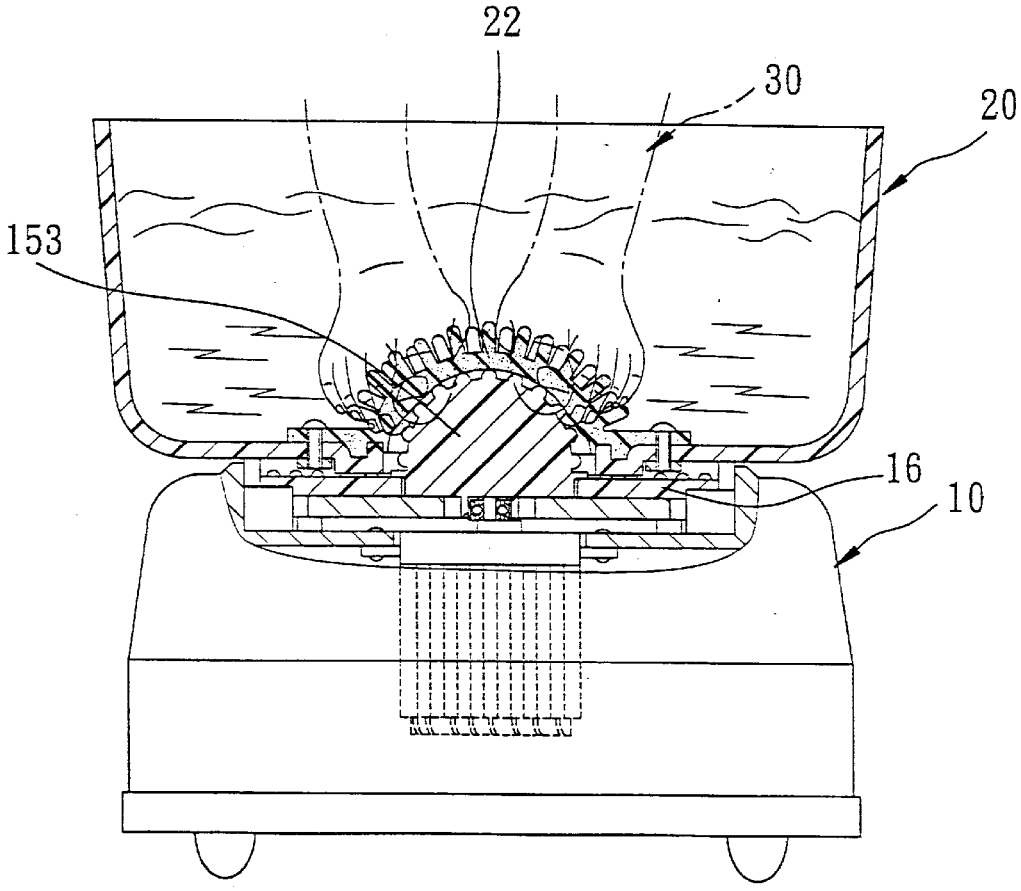
FIG. 4 is a cross-sectional view of the foot-immersing massaging machine in a used condition with feet stepping on the massage cushion in the vessel body; and, FIG. 5 is a side view of the foot-immersing massaging machine in a using condition in which the feet of a user steep on a vibrator of the body without the immersing vessel in the present invention.

Next, as shown in FIG. 4, when the user put the feet in the immersing vessel 20 and steps on the soft massaging cushion 22, the gap I disappear, and the massaging cushion 22 may be moved to disfigure by the vibrating member 153 so that the sole of the feet of the user can receive vibration of the vibrating member 153 through the cushion 22 as massaging.

As can be seen from the above description, a user may immerse the feet in the immersing vessel 20 and receive massage operated by the vibrating member 153 through the soft massage cushion 22 at the same time. Therefore, the foot-immersing massaging machine in the invention has better effect than the conventional foot-immersing massaging machine, which only uses water current for massage.

In case a user may not endure a long period of massaging, the user can stop massage after a certain period of using for a break, and begins massage again. Or a user can choose to immerse the feet 30 without massaging if needed.

Figure 5:
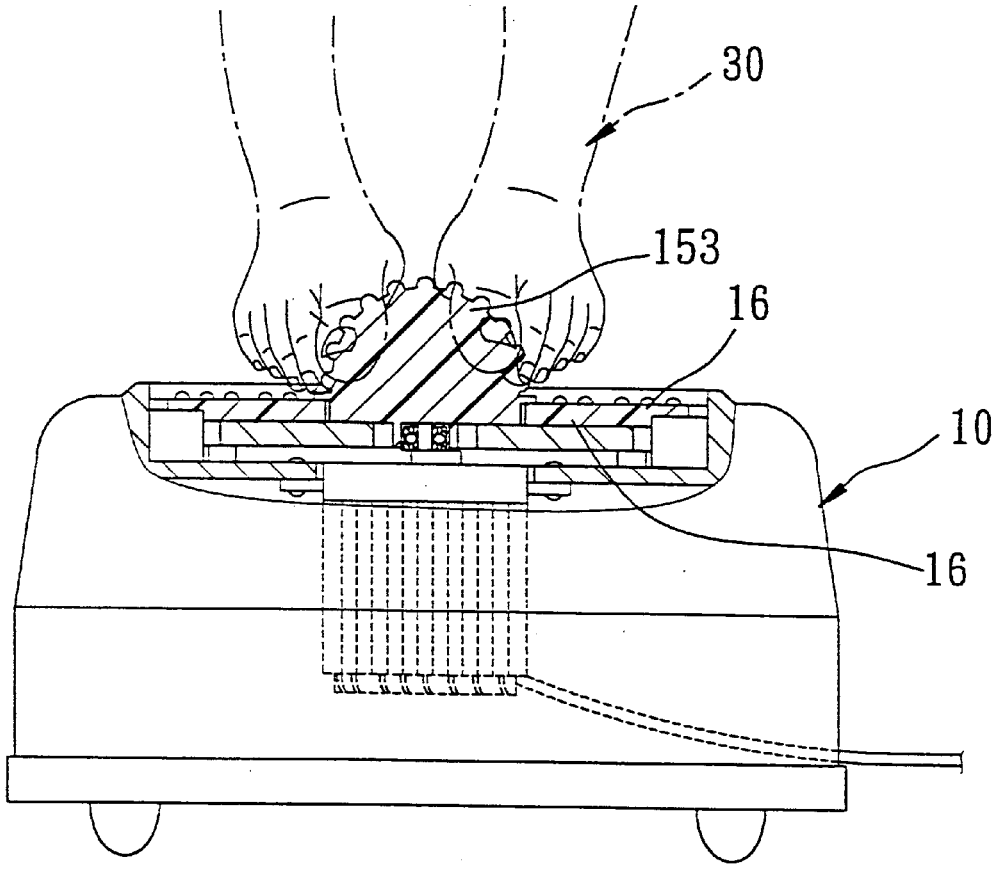

Moreover, as shown in FIG. 5, the vibrating member 153 has many small projections 223 and the anti-slop cushion 16 is positioned on the upper surface of the body 10, the body 10 itself can be used directly as a sole massaging machine without the soft immersing vessel 20, with the feet of a user directly stepping on the vibrating member 153.

While the preferred embodiment of the invention has been described above, it will be recognized and understood that various modifications may be made therein and the appended claims are intended to cover all such modifications that may fall within the spirit and scope of the invention.

I claim:

1. A foot-immersing massaging machine comprising;

A body having a housing, a motor, a switch, a power cord and a vibrating member, said motor installed in said housing and having a shaft protruding upward through an upper surface of said housing, said switch fixed at a preselected location of said housing and connected electrically with said motor, said power cord connected with said motor and said switch, said vibrating member fixed on said shaft of said motor and having an upper portion protruding upward out of said housing, said vibrating member producing minute vibration through an eccentric mode; and A foot-immersing vessel combined on said body and having a vessel body and a soft massage cushion, said vessel body having a hollow interior and an open upper side for feet of a user to place therein, said vessel body having a through hole in a center of a bottom for an upper portion of said vibrating member to protrude upward out, said soft massage cushion made of rubber, polymer or the like, said soft massage cushion closing up said through hole after said vibrating member is positioned in the center of said vessel body, a gap formed between said soft massage cushion and said vibrating member, said soft massage cushion having a plurality of small projections formed all over on an upper surface for two feet of a user to step thereon, wherein a vibrator of said body has an eccentric shaft, a bearing, and a vibrating member, said eccentric shaft having one end fixed on an upper end of said shaft of said motor at an eccentric point, said eccentric shaft having an other end extending in said bearing, said bearing buried and fixed in said vibrating member so as to enable said vibrating member to be rotated by said eccentric shaft via said bearing to produce minute vibration.

2. The foot-immersing massaging machine as claimed in claim 1, wherein said vibrating member is semi-spherical, and said soft massage cushion is also semi-spherical to coordinate to said vibrating member.

3. The foot-immersing massaging machine as claimed in claim 1, wherein said body has an upper surface provided with a circumferential stop edge projecting on said upper surface, and said immersing vessel has a stop member protruding under a bottom, said stop member having a lower end contacting an upper surface of said housing, said stop member having an outer edge just resting against an inner surface of said circumferential projecting edge and restricted by the same edge in the position.

4. The foot-immersing massaging machine as claimed in claim 3, wherein said stop member of said vessel body consist of three spaced apart boards.

5. The foot-immersing massaging machine as claimed in claim 1, wherein said housing of said body has a anti-slip cushion placed on an upper surface, and said anti-slip cushion has a center through hole for said vibrator to pass through upward.

6. A foot-immersing massaging machine comprising:

a body having a housing, a motor, a switch, a power cord and a vibrating member, said motor installed in said housing and having a shaft protruding upward through an upper surface of said housing, said switch fixed at a preselected location of said housing and connected electrically with said motor, said power cord connected with said motor and said switch, said vibrating member fixed on said shaft of said motor and having an upper portion protruding upward out of said housing, said vibrating member producing minute vibration through an eccentric mode; and a foot-immersing vessel combined on said body and having a vessel body and a soft massage cushion, said vessel body having a hollow interior and an open upper side for feet of a user to place therein, said vessel body having a through hole in a center of a bottom for an upper portion of said vibrating member to protrude upward out, said soft massage cushion made of rubber, polymer or the like, said soft massage cushion closing up said through hole after said vibrating member is positioned in the center of said vessel body a gap formed between said soft massage cushion and said vibrating member, said soft massage cushion having a plurality of small projections formed all over on an upper surface for two feet of a user to step thereon, wherein said immersing vessel has an annular groove formed in a bottom around said through hole, and said massage cushion has an annular flat member extending from a lower annular edge around said through hole, said annular flat member having an annular anti-leak ridge formed under a bottom, said annular anti-leak ridge engaging an annular groove of said vessel body, said annular flat member having a plurality of bolt holes, spaced apart equidistantly for bolts to pass to screw with and to combine said soft massage cushion with said vessel body.

7. The foot-immersing massaging machine as claimed in claim 6, wherein said vibrating member is semi-spherical, and said soft massage cushion is also semi-spherical to coordinate to said vibrating member.

8. The foot-immersing massaging machine as claimed in claim 6, wherein said body has an upper surface provided with a circumferential stop edge projecting on said upper surface, and said immersing vessel has a stop member protruding under a bottom, said stop member having a lower end contacting an upper surface of said housing, said stop member having an outer edge just resting against an inner surface of said circumferential projecting edge and restricted by the same edge in the position.

9. The foot-immersing massaging machine as claimed in claim 6, wherein said stop member of said vessel body consist of three spaced apart boards.

10. The foot-immersing massaging machine as claimed in claim 6, wherein said housing of said body has a anti-slip cushion placed on an upper surface, and said anti-slip cushion has a center through hole for said vibrator to pass through upward.

* * * * *